United States Patent [19]

Nablo et al.

[11] 4,246,297

[45] Jan. 20, 1981

[54] PROCESS AND APPARATUS FOR THE CURING OF COATINGS ON SENSITIVE SUBSTRATES BY ELECTRON IRRADIATION

[75] Inventors: Sam V. Nablo, Lexington; Alfred D. Fussa, Needham Heights, both of Mass.

[73] Assignee: Energy Sciences Inc., Burlington, Mass.

[21] Appl. No.: 940,034

[22] Filed: Sep. 6, 1978

Related U.S. Application Data

[63] Continuation of Ser. No. 742,134, Nov. 15, 1976, abandoned, which is a continuation of Ser. No. 530,942, Dec. 9, 1974, abandoned.

[51] Int. Cl.[3] ..... B05D 3/06

[52] U.S. Cl. ..... 427/44; 250/492 B

[58] Field of Search ..... 427/43, 44; 204/159.11; 250/492, 527

[56] References Cited

U.S. PATENT DOCUMENTS

| | | | |
|---|---|---|---|
| 2,785,313 | 3/1957 | Trump | 427/44 |
| 2,887,599 | 5/1959 | Trump | 313/74 |
| 3,144,552 | 8/1964 | Schonberg et al. | 250/492 |
| 3,247,012 | 4/1966 | Burlant | 427/44 |
| 3,702,412 | 11/1972 | Quintal | 315/39 |
| 3,713,935 | 1/1973 | Grecchi | 427/54 |
| 3,810,816 | 5/1974 | Zachariades | 427/44 |
| 4,113,894 | 9/1978 | Koch | 427/44 |

FOREIGN PATENT DOCUMENTS

| | | | |
|---|---|---|---|
| 991561 | 5/1965 | United Kingdom | 427/44 |

*Primary Examiner*—John H. Newsome

*Attorney, Agent, or Firm*—Rines and Rines, Shapiro and Shapiro

[57] ABSTRACT

This disclosure deals with a new process and apparatus for using a critically adjusted electron beam to cure protective and decorative coatings, including opaque, heavily pigmented coatings, on paper, fabric and other thin substrates which are sensitive to heat or various forms of radiation. The process utilizes restricted dose, energy and process rates to obviate degradation of the substrate during curing and to achieve previously unattainable line speeds in the curing of coatings on products of web, sheet and filamentary geometry.

5 Claims, 10 Drawing Figures

Figure 1:
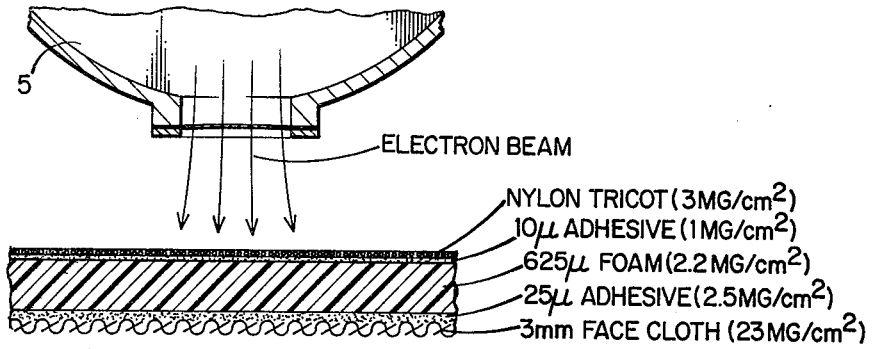

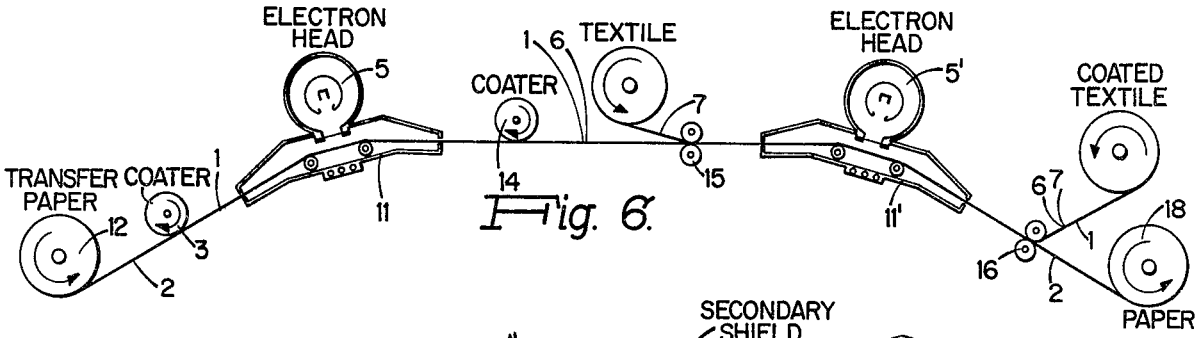
Fig. 6.
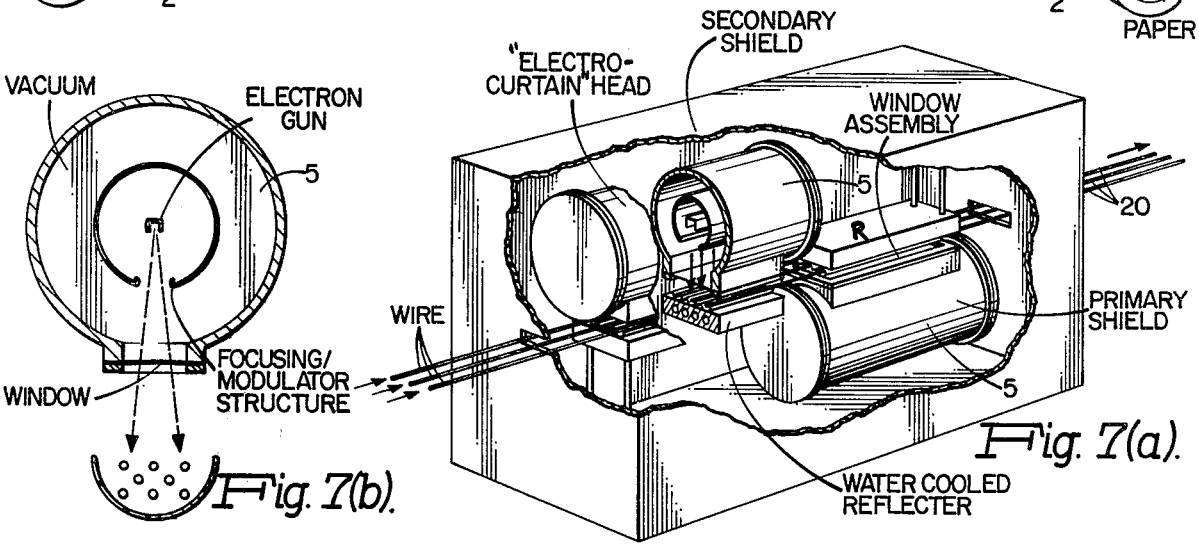
Fig. 7(b).
Fig. 7(a).
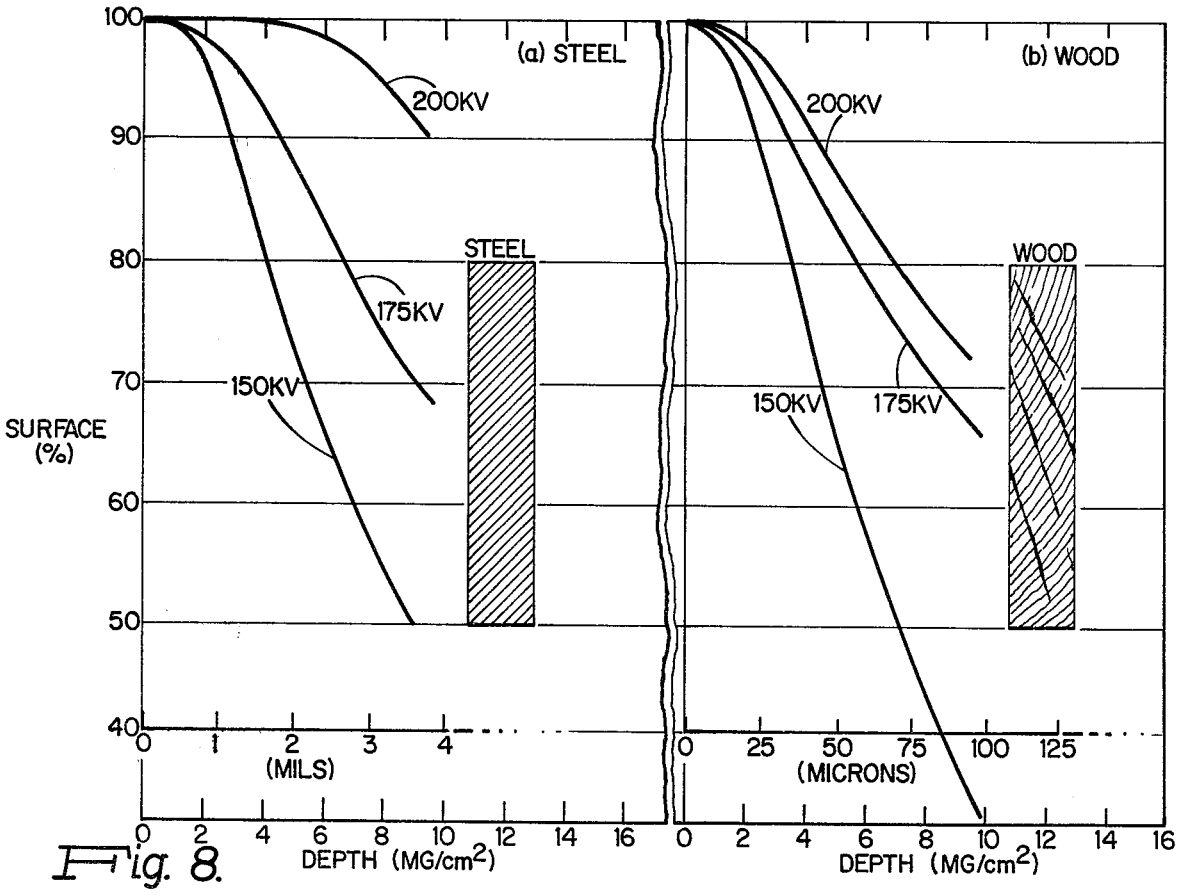
Fig. 8.

PROCESS AND APPARATUS FOR THE CURING OF COATINGS ON SENSITIVE SUBSTRATES BY ELECTRON IRRADIATION

This is a continuation application of Ser. No. 742,134, filed Nov. 15, 1976, which is a continuation of Ser. No. 530,942, filed Dec. 9, 1974, both now abandoned.

The present invention relates to processes and apparatus for curing coatings, both decorative and protective, secured to unsupported or supported sensitive substrates, which intrinsically limit the degree of practicable thermal or radiation curing and consequently restrict the possible speed of curing. More particularly, the invention also embraces the use of electron curing for the high speed transfer casting of films used for the forementioned applications. An unexpected benefit of the process herein disclosed, indeed, is the elimination of damage to the paper or plastic release sheets used to impart pattern or special finish to the cast film, so that these films can have a greatly increased lifetime in continuous transfer casting applications.

The curing of protective or decorative coatings applied to heat sensitive webs, such as paper or fabric, is usually accomplished by passing the product through a drying oven. Typically the coating is applied in a solvent solution of the coating resin, so that convective or radiative heating of the coated product in the oven leads to evolution of the solvent, and curing of the residual resin. Solvent concentrations may range from 20% to 60% by weight of the liquid coating, depending upon the viscosity required for application, flowout of the coating, wettability of the substrate surface and other factors affecting the coating process. In particular, for coated fabric applications, it is necessary to prevent excessive strike through of the coating into the fabric yarn so that a "boardy" or stiff hand in the fabric does not result. Complete solvent evaporation must occur from the coating before the next layer can be applied, so that a normal sequence is to apply several light coatings, each of which is fully cured by passage through the drying oven before the next application occurs.

Two large scale industrial examples of this rather laborious build-up of thermally cured, solvent based coatings are: urethane or vinyl coating of fabrics, and the (phenolic) insulating coating of magnet wire. Depending upon the thickness of the coating needed, four to twenty passes are used to build up to the final coating with oven temperatures limited so that boiling or bubbling in the coating will not occur as the volatile solvent is removed from the coating, with concomitant pin-holing or void creation in the film. These processes and related coating applications involve relatively thin coatings. For example, for coated fabrics, dry film thicknesses in the range of 25–80 microns (2–5 ozs. per 54 inch yard) are typical; for release coatings on paper, thicknesses of only 10 microns are typical; while for the wire coating application, film thicknesses of only a few microns are normally used.

An object of the present invention, accordingly, is to provide a novel electron-beam curing process which utilizes all solid (solvent free) coatings to obviate such prior art difficulties. In fact, because of the absence of high volatile concentrations in the coating and the room temperature nature of the process disclosed, the danger of pin-holing and hence coating failure is eliminated.

A further object is to provide a new and improved curing process and apparatus utilizing 100% reactive coating systems of more general applicability than those currently available. For example, similar coating systems which are dependent upon free radical-initiated polymerization for the cure may be treated with alternate radiation sources, such as ultraviolet, which, however, is unable to handle pigmented coating systems which readily absorb the ultraviolet at the surface, nor can it cure at high speeds on thermolabile substrates due to the low energy conversion efficiency of industrial ultraviolet lamps and therefore a concomitantly high infrared loading of the treated product. In addition, additives such as benzoin ethers or benzophenone required to sensitize the coating to ultraviolet are not needed with the process of the present invention, due to the ability of the curing energy (electrons) to create directly free radicals in the coating. As a consequence, coatings stable against storage and natural ultraviolet exposure are usable with the process of the invention.

Other and further objects are delineated hereinafter and are more particularly set forth in the appended claims.

Similar coating systems which are dependent upon free radical-initiated polymerization and which use other radiation sources, such as high energy electrons ($E \leqq 300$ keV as from a scanned accelerator) or gamma-rays ($E \sim 1.17$ or 1.33 MeV as from Cobalt 60 sources), are unable to limit or restrict the region of the product affected by the ionizing radiation. As a consequence, the substrate may receive a treatment level equal to or greater than that of the coating. In the case of many important polymers both natural (cellulose) and man-made (teflon, rayon, etc.), this may lead to degradation through bond-breakage or scission in the polymer. This process for many degrading (Group II) polymers, has been discussed in detail by Chapiro, Radiation Effects in Polymers of the Degrading Type, Ch. X, Radiation Chemistry of Polymeric Systems, Interscience Publishers, N.Y., 1961. In cotton, for example, radiation induced scission in the 1, 4-glycosidic bonds which link the anhydroglucose units of the macromolecule, lead to reduced tensile strength. Discoloration also occurs due to radiolytic effects, largely in the adsorbed water of this hydrophilic material. As a consequence, radiation curing of finishing or coatings on these materials has been impractical since the degradation of the substrate and its effects on product properties have not been tolerable. For these materials of the degrading type, it is clear that a radiation curing system must be discriminating in delivering its energy preferentially to the coating or finish so that substrate treatment is minimized.

Nor does the process disclosed herein suffer from the limitations of alternate all-solid coating process which do not utilize radiation. For example, powdered coatings (which also involve no solvents) still require a large thermal investment in the substrate to effect a change in the coating itself during the curing process. For paper or fabric coating, particularly with urethane systems, two-part coatings such as those described by J. C. Zemlin, "Development of a 100% Solids Urethane Fabric Coating Process," Proc. AATCC Symposium on Coated Fabrics Technology, 101–107, Mar. 28, 1973, are often used, which do eliminate solvent effluent and a large fraction of the waste heat required to cure conventional solvent based lacquers. Such systems are inflexible, however, and do not permit of thin coatings (below 40–50 microns) on light substrates, nor are they appropriate for temperature-sensitive substrates because of the high temperatures (100° C.) required to effect a cure.

In summary, from one of its broad aspects, the invention embraces a process for the curing of surface coatings such as acrylics, urethane, epoxies etc. applied or secured to a sensitive substrate that inherently limits the speed of curing. This comprises applying an electron-curable coating to the substrate, either by transfer of a cast film or by direct application, passing the laminate of substrate and uncured coating material past a predetermined region, directing the electron energy at said predetermined region upon the coating, adjusting the electron beam to produce a dose of up to 4 megarads of energy from, preferably, 50–200 keV, and with a line speed of passing the predetermined region preferably of the order of 20–100 meters per minute, in order to cure the applied coating without affecting the heat- or radiation-sensitive substrate. At the 4 megarad level, less than 10 calories of energy per gram of coating material are required for a cure, with less than 20% of this level reaching the substrate under the conditions outlined above. Assuming a coating specific heat of 0.3, coating temperature elevations of less than 30° C. are expected during the curing process, with much lower figures for the underlying temperature sensitive web. With precise control of the processor energy, electron induced substrate degradation is minimized in the same manner. Preferred details are hereinafter set forth.

Specifically, it has been discovered that if an electron strip beam is produced, as an illustration, by apparatus of the type described in U.S. Pat. Nos. 3,702,412, 3,745,396 or 3,769,600, and is critically controlled in accordance with the invention to direct its energy at a predetermined region upon the coated substrate with trajectories essentially perpendicular to the coating surface, precise control of the energy deposition profile is possible. This configuration and the control of energy deposition which it permits, are not possible with alternate energy sources, such as those described for example in U.S. Pat. Nos. 2,602,751 or 3,013,154, wherein the combination of the oblique incidence of the electrons on the permeable window, and the thick windows used, lead to very large scatter angles in the emerging electron distribution. A secondary advantage of the process is taught in U.S. Pat. No. 3,780,308 in which the high stopping powers of low energy electrons in the 100–150 keV region are utilized to increase the curing efficiency of the system at a given processor power level. It is only through the use of these electrons, at energies well below those heretofore available for industrial application, that the penetration of the curing flux through the coating to the labile substrate, can be controlled.

Figure 3A:
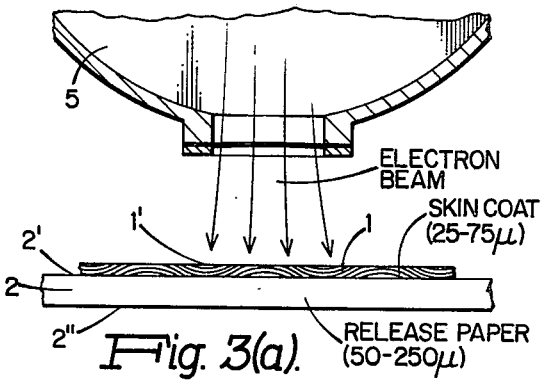
Figure 2:
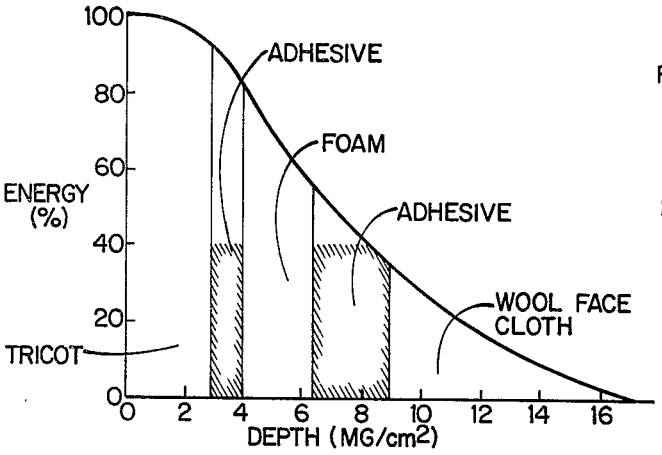
Figure 3B:
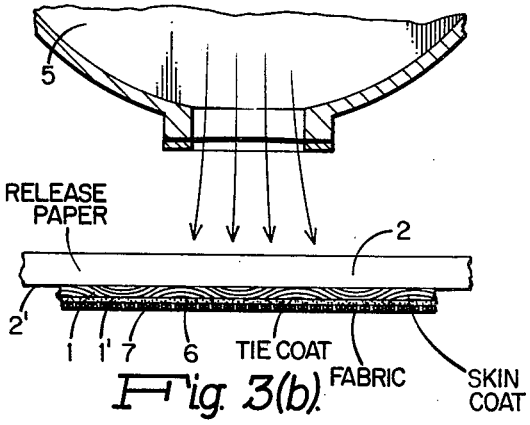
Figure 5:
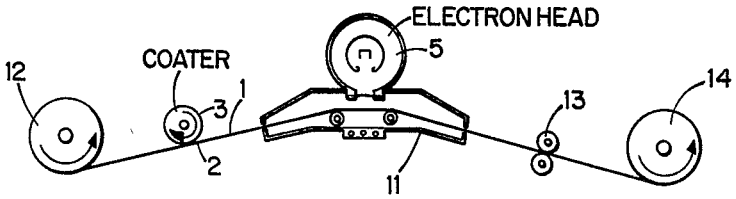

The invention will now be described with reference to the accompanying drawings, FIG. 1 of which is a longitudinal section illustrating electron-radiation geometries and adjustments for curing coatings on sensitive substrates in accordance with the invention;

FIG. 2 is a graph of energy penetrations in accordance with process controls of the invention;

FIGS. 3(*a*), 3(*b*) and 4 are views similar to FIG. 1 of modified irradiation techniques;

FIGS. 5 and 6 are schematic system diagrams;

FIGS. 7(*a*) and 7(*b*) are respectively isometric and longitudinal section drawings of the process as applied to filamentary products and the like and illustrating the use of primary electron back-reflection; and FIG. 8 is a graph illustrating low electron energy deposition profiles for coatings on steel and wood.

Referring to FIG. 1, the bonding of natural to man-made polymer systems is illustrated, using a wool face-cloth layer, so-labelled, bonded to a foam substrate or backing material, which is, in turn, faced with a nylon backing fabric layer, labelled "Nylon Tricot". Such a bonded or laminated fabric is typical of that used for garments and like applications. For this system, the adhesive was first applied with a Coin laminator, manufactured by the International Machine Builders Inc. of Guilford, Maine. A 625 micron ($\mu$) thick urethane foam substrate of density 0.034 gm/cc (i.e. 2.2 mg/cm$^2$) was used, to which a 25 micron film of Dow XD 7530.01 epoxy (or Hughson Chemical Co. B-210-30 polyurethane) adhesive was applied. The 7 oz/yd$^2$ (23 mg/cm$^2$) wool face cloth was then padded onto the adhesive film and cured at a rate of 60 meters per minute with an appropriately adjusted and operated Electrocurtain TM processor of the type described in the first-named U.S. patents, above, (Energy Sciences Inc. of Burlington, Massachusetts) and in Nablo, S. V. et al, "Electron Beam Processor Technology", Nonpolluting Coatings and Coating Processes, 179–193, ed. J. L. Gardon and J. W. Prane, Plenum Press, New York, 1972. The apparatus was adjusted to produce a dose of 2 megarads with an electron energy of 150 keV, with the curing flux directed through the electron-permeable nylon layer and the foam into the face cloth (wool)-urethane interface as shown in FIG. 1. The same adhesive was then applied with a standard 6-inch laminator to the open surface of the foam. The nylon fabric (1 oz/yd$^2$ or 3 mg/cm$^2$) was padded onto the foam-wool laminate, and the adhesive then cured at the same rate with the beam energy adjusted to 100 keV. The process shown in FIG. 1 proved to eliminate any "treatment" of the wool face cloth, either through heating or bombardment by ionizing radiation as illustrated in the energy deposition profile of FIG. 2, plotting energy as a function of depth, wherein it is shown that the positioning and adjustments have effected a matching such that the principal energy is concentrated and confined to the adhesive regions with minimal energy reacting with the cloth or other substrate. More general penetration properties of these low-energy electrons on steel and substrates are shown in FIG. 8.

These samples were subjected to standard washability and dry cleanability tests to ascertain that the laminate integrity was adequate, and that both adhesive films had been fully cured by such "rear-surface" treatment technique.

As a second example of the process of the invention, a pressure-sensitive adhesive has been applied and cured on a variety of heat and radiation labile substrates, including paper, vinyl, vinyl-asbestos, cork, wood, cotton, polystyrene, nylon, urethane film, leather and the like. For these applications, a radiation curable pressure-sensitive adhesive (e.g. W. R. Grace 711-C) is applied with a standard draw-down bar or knife applicator, to provide a wet film thickness in the 25–100$\mu$ range. This adhesive is then cured at line speeds of 60 meters/minute with such an Electrocurtain TM source adjusted to 150 keV by directing its beam onto and through the liquid film. In the same manner, it has been demonstrated that such pressure-sensitive adhesive coatings may be cured through a release paper or film layer, if necessary. In this way, as later explained, a coated and adhesive covered web or tape can be spooled or wound immediately after passage through the electron curing zone. The advantage of this single-pass, fast cure on a sensitive substrate in the production of products such as wall and floor coverings or pressure-sensitive tapes will be obvious to those skilled in this art.

A further example of the process for the transfer casting of films onto fabrics is illustrated in FIGS. 3(*a*), 3(*b*) and 4. As shown in FIG. 3(*a*), the skin or top coat 1, typically 1–3 mils (25–75μ)thick, is applied directly to a release paper 2, typically of 4–6 mils (100–150μ) thickness, with a density of 0.9–1.0 gm/cc, the release paper being on the side remote from the electron beam window. Flexible, elastomeric coatings with good wear characteristics are used for this purpose, such as Hughson's RD-2484-18 urethane. Using electron energies of 80–110 keV from the said Electrocurtain TM processor described earlier, this skin coat can be "set" at 0.2–1.0 megarad, or fully cured at 2–5 megarads, with less than 20% of the curing energy reaching the release paper itself. This has been confirmed experimentally through measurements of the dose delivered at the surface 1' of the skin coat 1 and at the front and rear surfaces 2' and 2'' of the release paper 2. Typical treatment ratios of 5:1:0 were respectively measured for the setting already described with the treatment geometry shown in FIG. 3(*a*).

As shown in FIG. 3(*b*), on the other hand, a thin adhesive or tie coat 6 is now applied to the surface 1' of the skin coat 1 and the support fabric 7 is napped or rolled into it. The tie coat 6 is then cured by treatment through the electron-permeable release paper 2 and skin coat 1, as shown, with the release paper now adjacent the electron beam window. Electron energies of from 130–180 keV are typically used here to provide penetration of the release paper 2 and skin coat 1, and delivery of adequate energy for curing of the tie coat 6 at the fabric-adhesive interface. For the example described, where a cotton support fabric was used with a weight of 12 ozs/yd$^2$ (42 mg/cm$^2$), dose levels measured at the release paper rear surface 2', tie coat-fabric interface 6, and support fabric rear or bottom surface, as shown, were typically 10:6:0. The process disclosed herein effectively eliminates the undesirable treatment of the supporting web which is, however, intrinsic to all prior processes, using either heat or radiation sources of curing energy.

It is therefore possible, in accordance with the invention, to cure the tie coat without significantly affecting the support web or fabric, and simultaneously to fully cure the tie coat and the skin coat, which had been only partially cured or "set" by the first treatment. Another important benefit of the process herein described is the reduced degradation of the release paper so that it may be removed after release of the skin coat, and used again in the process. In the conventional thermal curing process, on the other hand, release papers may only be used 3–5 times before being discarded due to thermal degradation. At a cost of 15–20 cents per square yard, this limited release paper reuse is of economic importance, as it represents a process cost comparable to the coating/adhesive costs. The process described herein permits almost unlimited (typically 50 times) reuse of the release film or paper, determined by the minimal radiation degradation of the paper by the tie-coat curing process of FIGS. 3(*a*) and 3(*b*).

Figure 4:
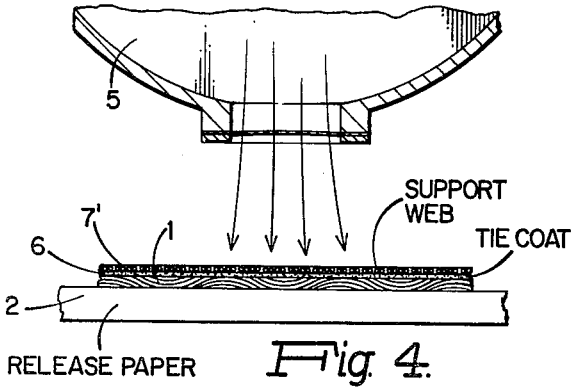

As shown in FIG. 4, furthermore, the final curing process may also be reversed where thin or loosely woven support webs or fabrics 7 are used. In this case, the cure is effected with the energy directly applied from the rear through the uncoated support fabric surface 1, so that no substantial energy is delivered to the release coating or paper 2, and its unlimited reuse is assured. This technique has been demonstrated with a curing electron flux at energies of 180 keV where a very heavy 10 oz/yd$^2$ (35 mg/cm$^2$) cotton fabric 1 was used as the backing web. Because of the reduced scattering angles and normality of incidence at the product surface provided by the Electrocurtain TM processors adjusted and operated as before explained, good penetration of the woven backing fabric is possible, even for fabric weights well beyond the intrinsic penetration capability of incident electrons predictable from prior art teachings. The process of FIG. 4 is thus particularly useful for non-degrading supporting webs.

Two main systems for direct and transfer casting coating, made possible with this invention, are illustrated in FIGS. 5 and 6, respectively.

In FIG. 5, the flexible web or substrate 2 is unrolled from drum 12 and coated with an electron curable coating by coater 3. The coated web 1–2 is then presented to Electrocurtain TM processor 5 or equivalent, via web handling fixture 11; and the cured coated web is then drawn by capstan 13 onto take-up roller 14.

In FIG. 6, the transfer casting system is illustrated in which the transfer paper 2 is drawn from drum 12 and the skin coat 1 is applied at the coating station 3. The coated paper or film is then introduced to the electron curing station 5 via the web-handling system 11. After the skin coat set or cure at station 5, the tie coat 6 is then applied at coater 14 to which the supporting fabric or textile 7 is nipped in, via the padder station or nip rollers 15. The laminate is then cured through the backing fabric 7 by station 5' and laminate-handling assembly 11' (as described in FIG. 4), or via the reverse process discussed above and depicted in FIG. 3(*b*). The coated product 7–6 is then rewound after separation or peeling away at 16 of the paper 2, which is then wound for re-use on drum 18.

Still a further example of the flexibility of the process of the invention, by the before-described apparatus of FIG. 5, involving the single-pass curing at high speeds of binders as used in the manufacture of non-woven fabrics, has been demonstrated. In this application, the flexible web 2, which is unrolled from drum 12, or as taken directly from the web lay-up line, is bonded at station 3 by means of the application of an adhesive with a gravure type cylinder or similar printing station. In this case, the patterned adhesive layer 1 permeates the printed sections of the non-woven web and is presented to the electron-processor curing station 5. After curing, the web now has good tensile strength in both dimensions and is self supporting, such that it may be drawn through nip-rollers 13 to the rewind cylinder 14 or to a further finishing station.

In such operation, pure polyester non-woven web of weight 3.3 mg/cm$^2$ (0.96 oz/hd$^2$) and pure rayon non-woven web of weight 3.5 mg/cm$^2$ (1.02 oz/yd$^2$) were printed with electron curable binders such as: Reichhold's polyester adhesive type 31039, C. L. Hauthaway's urethane adhesive type 139A or Hughson's urethane adhesive type 2536–30, all of these being 100% solids. These webs were processed in a CB 150 type Electrocurtain TM of the assignee, Energy Sciences, Inc., at line speeds of from 5–50 meters/minute and at dose levels of from 2–5 megarads. The electron beam energies used here were in the range of 100–125 keV. The webs so-bonded with this process, were found to be of good hand and tear strength, and demonstrated that the print-bonding process could be performed at high speeds with commercial webs using such low-energy electron curing technique, and with no measurable degradation in the physical or cosmetic properties of the cellulosic or man-made web.

Another example of the process of the invention involved the use of a Highson urethane top-coat RD-2536-59 which was rolled on to a heavy (16 oz/yd$^2$) vinyl coated upholstery fabric. The protective sealing topcoat was cured at a line speed of 50 meters/minute and at a dose level of 3 megarads. At lower doses, the trichlorethylene and solvent resistance were marginal. At levels for full cure, the samples passed a 50,000 cycle wear test on a Wyco Wear Tester, and 25,000 single flexes and 10,000 fold tests. This topcoat satisfied other tests on cold fold, crocking, soil resistance, and related requirements for the coated fabric topcoat application.

Further to show the wide utility of the invention, the process is illustrated in FIG. 7 as applied to the single pass curing at high speeds of thin enamel coatings of good dielectric strength on wire; this being accomplished with the use of low energy (<100 keV) from the before-described processor. Such technique is equally appropriate for the curing of finish coatings on yarn made up of natural fibers (wool, cotton), man-made fibers (nylon, orlon, dacron, fiberglass, etc.) or blends thereof. As with the coating applications mentioned earlier, solvent blow-out of the coating with the conventional thermal process is a severe problem. As a result, multiple pass coating-curing is necessary so that 12–24 passes may result in a typical magnet wire enamelling application (using high solvent concentration phenolic lacquers). The process of the invention applied to such uses is shown in FIG. 7(*a*), utilizing a single-pass cure of a 100% solids coating (such as Hughson RD-2536-59 or Cray Valley Products SF-71475) which can be accomplished at very high line speeds along the length of the electron processors, as of the type described in before-cited U.S. Pat. Nos. 3,702,412; 3,745,396 or 3,769,600. As shown in FIG. 7(*a*), with treatment zones some 15 cm in length, process speeds of some 1000 meters per minute have been found possible with these available electron cured coatings. Several coated ends (yarn, wire, cable, string, ropes, threads, monofilament plastic, etc.) may be passed simultaneously along the longitudinal symmetry axes of a pair of successive upper and lower or opposite-direction electron processor stations 5, longitudinally along the space between their electron windows and corresponding longitudinally mounted planar water-cooled or similar reflectors R, for returning primary electrons back to the underside of the wires or other product. The processor housings serve as a primary electron radiation shield, and the housing into which the wires or filaments are fed, from the left, and from which they exit at 20, serves as a secondary shield. Full utilization is thus made of the energy pattern or curing zone provided by the processors. For example, several levels of many ends are possible to fully utilize the curing flux for the surface finishing of yarns.

This process utilizes the ability of high atomic number materials to reflect, with high efficiency, low energy electrons. For example, the work of A. Bisi and L. Braicovich, Nucl. Phys. 58, 171, 1964, for low energy electrons showed that these backscatter coefficients could rise to over 50% at Z=50 (for tin or above) and reached 70% at Z=82 (lead). These backscattered electrons, N, fall into a roughly Gaussian distribution described by $$N = N_o \cos x . e^{-x2/2},$$

where $N_o$ is the incident flux and $x = \pi - \alpha$, where $\alpha$ is the angle between the backscattered electron and the normal to the surface of the reflector. This distribution of reflected energy, coupled with the scattering of the primary beam in the air path about the coated filament, can provide a highly uniform treatment about the periphery of the cylindrical workpiece with bilateral treatment.

This has been demonstrated using the configuration shown in FIG. 7(*b*), in which a reflecting semi-circular or concavely shaped channel R of an electron-reflecting high atomic number material, such as tantalum (Z=73) or lead (Z=82), is used to direct a large percentage of the primary electrons from the processor 5 that have gone around or past the product, back to the underside of the product, shown as wires or strands or filaments. As in the case of the reflectors R of FIG. 7(*a*), the reflector R of FIG. 7(*b*) is disposed below or on the opposite side of the product from the electron window but in an area in substantial register therewith. Measurements of the deposited energy distributions about the periphery of a 1 and 2 mm diameter workpiece (#18 and #12 AWG wires, respectively), with a CB 150 Electrocurtain TM electron processor 5, demonstrated that single pass treatment uniformities of ±20% and ±15% were respectively possible with the bilateral backscatter technique illustrated in FIG. 7(*a*).

As a further demonstration of the process, tests using several ends of cotton perle and wool yarn coated with adhesives (Hughson RD-2526-67) were also performed to demonstrate single pass uniform curing using the approach illustrated in FIG. 7(*a*), as well as to demonstrate the uniform excitation of free radicals about the periphery of the yarn, as is used, for example, in the dry or pre-irradiation of textiles prior to graft copolymerization of a subsequently coated film. Such graft copolymerization processes have been described, for example, by Chapiro et al in U.S. Pat. Nos. 3,131,138; 3,298,942; 3,433,724, etc. The tests performed in these demonstrations also utilized the configuration of FIG. 7(*b*) in which adhesive coated yarn (cotton) which had been coated with a free-radical curable urethane (Hughson RD-2536-56) to a thickness of ~50μ, and then flocked with 3 denier×260μ nylon fibers, was given a single-pass cure. This verified the ability of the unilateral source coupled with the appropriate backscatter geometry to provide full cures of thin coatings, including flock "protected" adhesives, with the single-pass process, as the yarn "texturized" in this manner showed good abrasion resistance and tensile strength. The reflection concept of FIGS. 7(*a*) and 7(*b*) may also be used, where appropriate, with other work pieces or products such as those of the other figures.

The following Table I presents the approximate ranges of energies and doses of energetic electron radiation and corresponding attainable line speeds for various types of products treated in accordance with the invention:

TABLE I

50–300 keV range and doses of from 1–5 megarads, for the curing of free-radical initiated laminating adhesives in the textile field at line speeds of from 10–100 meters/minute, particularly for lamination of man-made or natural fabrics to heat-sensitive substrates such as expanded foams (pvc, urethane, etc.) or non-woven webs (paper, cotton, polyester, etc.) used as a backing "fabric"; 50–300 keV range and doses of from 0.5–3 megarads for the curing of free-radical initiated bonding agents at line speeds of from 25–200 meters/minute as used, for example, in the manufacture of non-woven webs of paper, cotton, polyester, rayon and like temperature sensitive fibers; 50–300 keV range and doses of from 1–8 megarads for the curing of elastomeric type coatings on substrate fabrics, including non-wovens, at line speeds of from 10–60 meters/minute, including fabric coatings of free-radical initiated urethanes, vinyl compounds and like flexible skin coats which may be applied by either direct coating or transfer casting; for the curing of a thin sealing topcoat on coated fabrics, leather, leather substitutes, paper, laminates and like temperature-sensitive matte for plasticizer sealing, abrasion resistance, cosmetic improvement, coefficient of friction modification, including protective topcoats for upholstery and garment applications, energetic electrons in the 50–150 keV range and doses of from 0.25–2 megarads at line speeds of from 40–250 meters/minute; 50–300 keV and doses in the range of 0.5–5 megarads, for curing pressure sensitive adhesive on temperature-sensitive webs such as paper, plastic and the like, either directly, through a release paper, or through the overlying web to which it is applied, and at line speeds of 20–100 meters/minute; 50–150 keV and doses in the range of 1–4 megarads for curing coatings on magnet wire cylindrically symmetric work pieces, with the coatings of thicknesses in the range of 5–50 microns and with the use of backscatter reflector shields to flatten the curing dose distribution about the periphery of the coated conductor, at product speeds in the range of 50–1000 meters/minute; 50–300 keV range and doses of from 0.5–3 megarads at product speeds of 20–1000 meters/minute, for curing adhesive and finish coatings on textile fibers and yarn for flock texturizing, soil release improvement and the like; 50–250 keV and doses of from 0.5–2.5 megarads at product speeds of 10–80 meters/minute for the cure of pigmented decorative finishes used in both the pigment and dye printing of textiles, plastics and ceramics, including glass; and 50–200 keV and doses in the range of 1–5 megarads at web speeds of 20–200 meters/minute, to cure release coatings such as silicones, polyesters and the like on paper, non-woven webs or similar heat-sensitive substrates.

While, as above explained, the relatively low energy energetic electron radiation used in accordance with the invention is preferably generated as a linearly extending fan or curtain, a beam of such radiation may be moved or scanned, or a plurality of contiguous beams used, to provide extension linearly along the treatment region within the adjustment ranges above presented.

Further modifications will also occur to those skilled in this art, and all such are considered to fall within the spirit and scope of the invention as defined in the appended claims.

What is claimed is:

1. A process for substantially uniform electron beam curing of a coating disposed within an assembly having an electron permeable release layer that carries the coating and that is in turn applied to a radiation-sensitive substrate, comprising, passing the coated release layer substrate assembly along a predetermined path; accelerating electron strip beam radiation through an electron-permeable window adjacent to a predetermined region of said path and causing the accelerated strip beam radiation to impinge upon said region over the entire elongated cross-sectional area of the beam simultaneously and substantially uniformly perpendicular to said path; maintaining substantially the entire impinging strip beam radiation at said region at a predetermined energy level selected within energy limits of from substantially 80 to 180 keV; and adjusting the dose delivered by the beam at that predetermined energy level to the coated release layer substrate assembly at said region to a predetermined value within dose limits of from substantially 0.5 to several megarads; the energy and dose being matched to the thickness and materials of the coated release layer and substrate in order to concentrate the principal amount of the electron strip beam energy substantially uniformly in said coating and to cure the coating while insuring minimal energy reaction with the release layer and substrate; and peeling the release layer from the substrate with its cured coating for subsequent use.

2. A process as claimed in claim 1 and in which the electron permeable release layer comprises release paper of thickness of the order of 100–150$\mu$ and of density of the order of 0.9–1.00 gm/cc. with an adhesive coating of thickness of the order of 25–75$\mu$.

3. A process as claimed in claim 1 and in which the release layer is disposed adjacent to said window, with the coated substrate farther from the window.

4. A process as claimed in claim 1 and in which the coated substrate is disposed adjacent to said window with the release layer farther from said window.

5. A process as claimed in claim 1 further comprising reflecting electron beam energy which passes around and past said coated substrate back into the same from an area in substantial register with, but on the opposite side of, the substrate from said window.

* * * * *